US011378268B2

(12) United States Patent
Eberhardt

(10) Patent No.: US 11,378,268 B2
(45) Date of Patent: Jul. 5, 2022

(54) LUMINAIRE HAVING A PLUG CONTACT, THE USE OF A LUMINAIRE OF THIS KIND, AND A CONNECTOR FOR A LUMINAIRE OF THIS KIND

(71) Applicant: HERBERT WALDMANN GMBH & CO. KG, Villingen-Schwenningen (DE)

(72) Inventor: Marcus Eberhardt, Aixheim (DE)

(73) Assignee: HERBERT WALDMANN GMBH & CO. KG, Villingen-Schwenningen (DE)

( * ) Notice: Subject to any disclaimer, the term of this patent is extended or adjusted under 35 U.S.C. 154(b) by 0 days.

(21) Appl. No.: 17/066,635

(22) Filed: Oct. 9, 2020

(65) Prior Publication Data

US 2021/0108791 A1 Apr. 15, 2021

(30) Foreign Application Priority Data

Oct. 11, 2019 (DE) ..... 102019127442.7

(51) Int. Cl.

| | |
|---|---|
| ***F21V 23/06*** | (2006.01) |
| ***F21V 17/18*** | (2006.01) |
| ***F21S 8/00*** | (2006.01) |
| ***H01R 35/04*** | (2006.01) |
| ***F21W 131/402*** | (2006.01) |
| ***F21V 15/01*** | (2006.01) |

(52) U.S. Cl.

CPC ..... *F21V 23/06* (2013.01); *F21S 8/03* (2013.01); *F21V 15/01* (2013.01); *F21V 17/18* (2013.01); *H01R 35/04* (2013.01); *F21W 2131/402* (2013.01)

(58) Field of Classification Search

CPC ..... F21V 23/06; F21V 17/18; F21V 15/01; F21S 8/03; H01R 35/04

See application file for complete search history.

(56) References Cited

U.S. PATENT DOCUMENTS

| | | | | |
|---|---|---|---|---|
| 8,133,059 | B1 | 3/2012 | Hsiao | |
| 10,113,708 | B1 | 10/2018 | Tress | |
| 2004/0184295 | A1 | 9/2004 | Robertson et al. | |
| 2014/0313774 | A1* | 10/2014 | Myers | F21K 9/61 362/612 |

FOREIGN PATENT DOCUMENTS

| | | | |
|---|---|---|---|
| DE | 39403943 | T2 | 12/1997 |
| DE | 20310788 | U1 | 10/2003 |
| DE | 202004010287 | U1 | 10/2004 |

(Continued)

OTHER PUBLICATIONS

Machine Translation of WO 2004/029506 (Year: 2004).*
Office Action dated May 20, 2020, in corresponding German patent application No. 10 2019 127 442.7.

*Primary Examiner* — Leah Simone Macchiarolo
(74) *Attorney, Agent, or Firm* — Nath, Goldberg & Meyer; Jerald L. Meyer

(57) ABSTRACT

A luminaire (1) having a preferably flat light exit region (2) that is surrounded by a rectangular light frame (10), wherein the luminaire frame (10) spans a first plane (E) and has a frame height (H) that is perpendicular to the first plane (E) and, at one of its corners (11), a beveled surface (12) in which a plug contact (30) is arranged, and an electromechanical plug connector for a luminaire of this kind are provided.

15 Claims, 3 Drawing Sheets

(56) References Cited

FOREIGN PATENT DOCUMENTS

| | | | |
|---|---|---|---|
| DE | 102010010343 | A1 | 9/2011 |
| DE | 102017120059 | B3 | 12/2018 |
| EP | 1546604 | B1 | 7/2006 |
| EP | 2693582 | A1 | 2/2014 |
| EP | 2887463 | B1 | 6/2015 |
| WO | 2004/029506 | A1 | 4/2004 |

* cited by examiner

LUMINAIRE HAVING A PLUG CONTACT, THE USE OF A LUMINAIRE OF THIS KIND, AND A CONNECTOR FOR A LUMINAIRE OF THIS KIND

The invention relates to a luminaire having a plug contact, the use of a luminaire of this kind, and a connector for a luminaire of this kind.

Luminaires, especially luminaires that are intended to be attached to the ceiling of a large room or hall such as an open-plan office or a machine or production hall usually have to be installed in such a way that they meet two basic conditions at the same time. Firstly, the luminaire should illuminate the corresponding workplace as well as possible. Secondly, it should be connected to the power supply, which is usually structurally predetermined, as directly as possible.

In order to be able to meet these goals at the same time, luminaires of this kind have so far been offered with different connection configurations. Therefore, a given type of luminaire, for example, variants with connections for the power supply on the back of the luminaire or connections that are arranged in different arrangements and with the connection directions on the side of the luminaire, can be used.

This approach has disadvantages for both the customer and the manufacturer of the luminaires. Customers repeatedly place incorrect orders, because the correct connection direction must be observed when ordering. Furthermore, when the work-stations are reorganized, luminaire have to be rearranged, but are then oriented such that their connection no longer points in the correct direction. For the manufacturer, this means that different housings are required, which entails more complex assembly.

Therefore, the aim of the invention is to provide a luminaire having a plug contact and a plug connector for a luminaire of this kind, which allow a luminaire of this kind to be connected in different directions in the room without the use of tools.

This aim is achieved by a luminaire with the features of claim 1 and by a plug connector with the features of claim 8. The respective dependent claims disclose advantageous embodiments of the invention.

The luminaire according to the invention has a light exit region that is preferably plate-shaped. The light exit region is surrounded by a rectangular luminaire frame that spans a first plane and has a frame height that is perpendicular to the first plane. Said luminaire frame has a beveled surface at one of its corners in which a plug contact is arranged.

In other words, one of the normally eight corners of a luminaire frame of this kind is, in effect, cut away and replaced by the beveled surface that is subsequently formed by the cut surface.

Beveled preferably means that a surface normal of the beveled surface is neither parallel nor perpendicular to the first plane and that none of the edges of the beveled surface extends in parallel with one of the edges that are associated with one of the other frame surfaces and do not abut the beveled surface.

The arrangement of the plug contact in a beveled corner of this kind allows a cable to be led away from the luminaire in different spatial directions by means of an angled plug. If the luminaire is to be supplied with power from a different direction, the angled plug simply has to be plugged into the plug contact in a different orientation.

It is particularly preferable for the beveled surface to extend at an angle of at least approximately 45° to the first plane, i.e., at an angle of approximately 45° or more than 45° to this plane, an angle from the range between approximately 45° and about 60° being particularly preferable. The reason for this is that, by choosing a suit-ably angled plug, this angular range makes it possible for the directions from which the luminaire can be supplied with power to be almost perpendicular to one another.

In a preferred embodiment of the invention, the beveled surface is trapezoidal when viewed from above (or, in other words, has a peripheral line that defines such a shape) in such a way that the shorter face of the trapezoid faces toward the light exit region and the longer face of the trapezoid faces away from said region.

A surface of this kind is obtained when the beveled surface corresponds with a cut surface with which two of the normally eight corners of the luminaire frame are cut away by cutting lines that are at a different distance from the cut corner. One ad-vantage that is achieved in this way is that the surface that is provided for connecting or contacting the plug contact inside the luminaire is larger. This is particularly advantageous when the luminaire has control electronics that are arranged in the interior of the luminaire on a printed circuit board or plate and when the plug contact is integrated on said printed circuit board.

In order to arrange control electronics of this kind in the interior of the luminaire, it can also be useful if one face of the luminaire frame which abuts the beveled surface has a U-profile, having a bottom of the U that extends in parallel with the frame height and having limbs that are situated in the plane of the light exit region and in the plane of the rear face of the luminaire which is opposite the light exit region. The frame thus forms a housing portion on this face, in which portion the control electronics, which are subsequently virtually located in the interior of the U-profile, are integrated.

If, according to a preferred embodiment of the invention, the beveled surface comprises an opening or recess in which the plug contact is located, this can help ensure that the cables can be run at a small distance from the frame. In particular, if this opening or recess is a polygon, preferably a hexagonal pocket, a series of discrete, defined plug positions corresponding with different cable run directions can be predetermined by the geometry of said polygon. However, such geometry can also be used to provide a counter bearing for adjusting the cable run direction of the plug when connected to the plug contact.

In particular, if such an adjustment of the cable run direction is to be possible, it is advantageous if the plug contact located in the recess or opening comprises sliding contacts. This also allows for unlimited rotation of the plug without an end stop and does away with the need for stranded wires or cables.

It is particularly preferable to use a luminaire according to the invention.

An electromechanical plug connection according to the invention comprises a plug for arranging on a cable and a mating plug for arranging on an electrical device, which mating plug can be designed, in particular, as a plug contact. In particular, the electrical device can be a luminaire according to the invention.

The plug comprises a contact region for establishing mechanical contact with the mating plug and for establishing electrical contact between contacts of the plug and contacts of the mating plug and additionally comprises a connection region for connection to the cable, which region extends at an angle from the contact region.

The plug and the mating plug also comprise means for forming a form fit when force is applied to said means and when the plug and mating plug are connected, which are designed such that the form fit can be established in different positions that each lead in different extension directions of the connection region of the plug (and therefore also of a cable connected thereto) in the room.

The plug and/or the mating plug also comprise means for resiliently applying a force to the means for forming the form fit so that the form fit can be transferred from a first position of the different positions to a second position of the different positions by the force being temporarily overcome.

Finally, the contacts of the plug and/or the contacts of the mating plug are designed such that, in all positions in which the form fit is established, electrical contact is established at least between some contacts of the mating plug and some contacts of the plug.

In this way, an electromechanical plug connector that is small in size can be easily connected, and a plurality of different orientations can be provided.

It is preferable for the contact area and the connection region to extend at an angle of at most approximately 45°, a range between approximately 30° and approximately 45° being particularly preferable.

According to a preferred embodiment of an electromechanical plug connector of this kind, it is designed to be rotatable so that the form fit can be transferred from a first position of the different positions to a second position of the different positions by the force being temporarily overcome by rotating.

It is also advantageous if this electromechanical plug connector, as a means for forming a form fit when force is applied to said means and when the plug and mating plug are connected, which are designed in such a way that the form fit can be established in different positions that each lead in different extension directions of the connection region of the plug (and therefore also of a cable connected thereto) in the room, has a plurality of latching positions, the latching positions each being assigned to a different rotational position of the plug.

In a preferred embodiment of the invention, the means for resiliently applying a force to the means for forming the form fit are realized in that the latching connection is in operative connection on the plug and an assigned insert groove in the opening or recess of the luminaire frame by means of an annular spring.

The invention is explained in more detail below with reference to drawings that disclose embodiment examples. In the drawings.

The same components are shown with the same reference symbols throughout the drawings.

Figure 1:
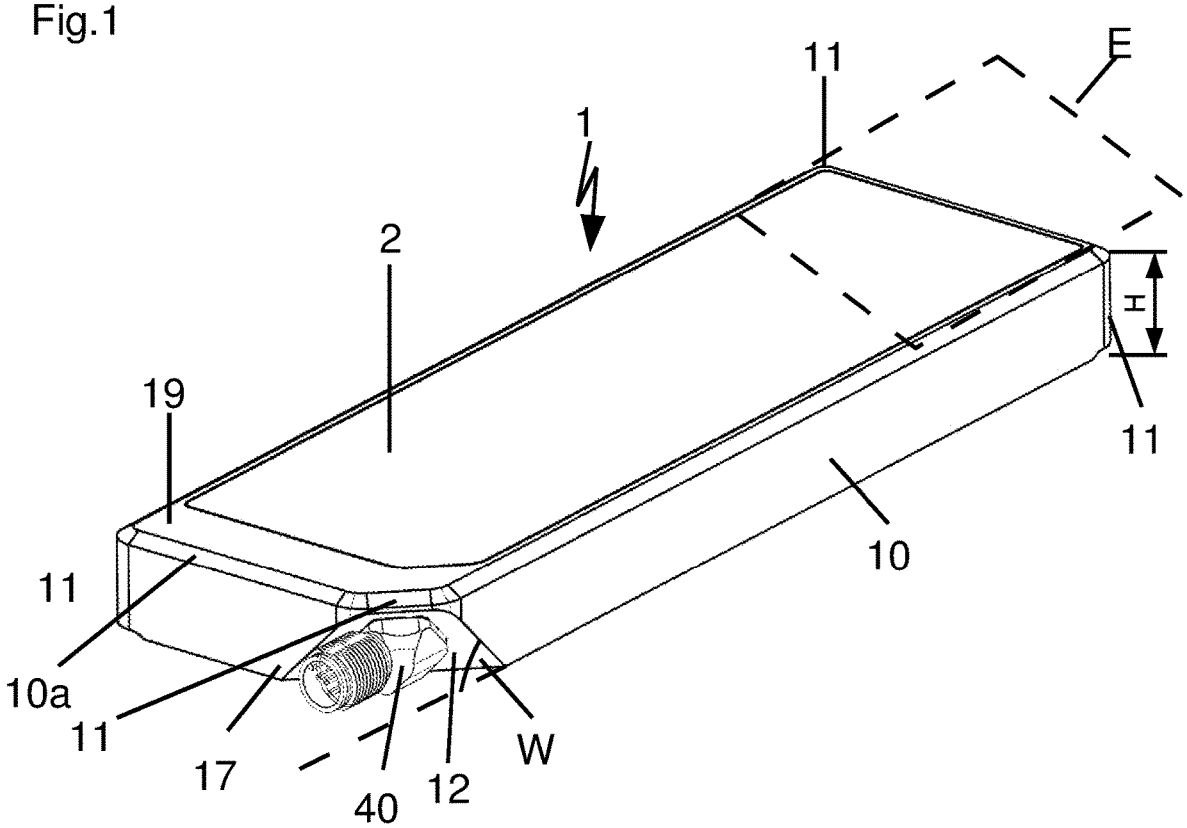
FIG. 1 is an embodiment example of a luminaire.
Figure 6:
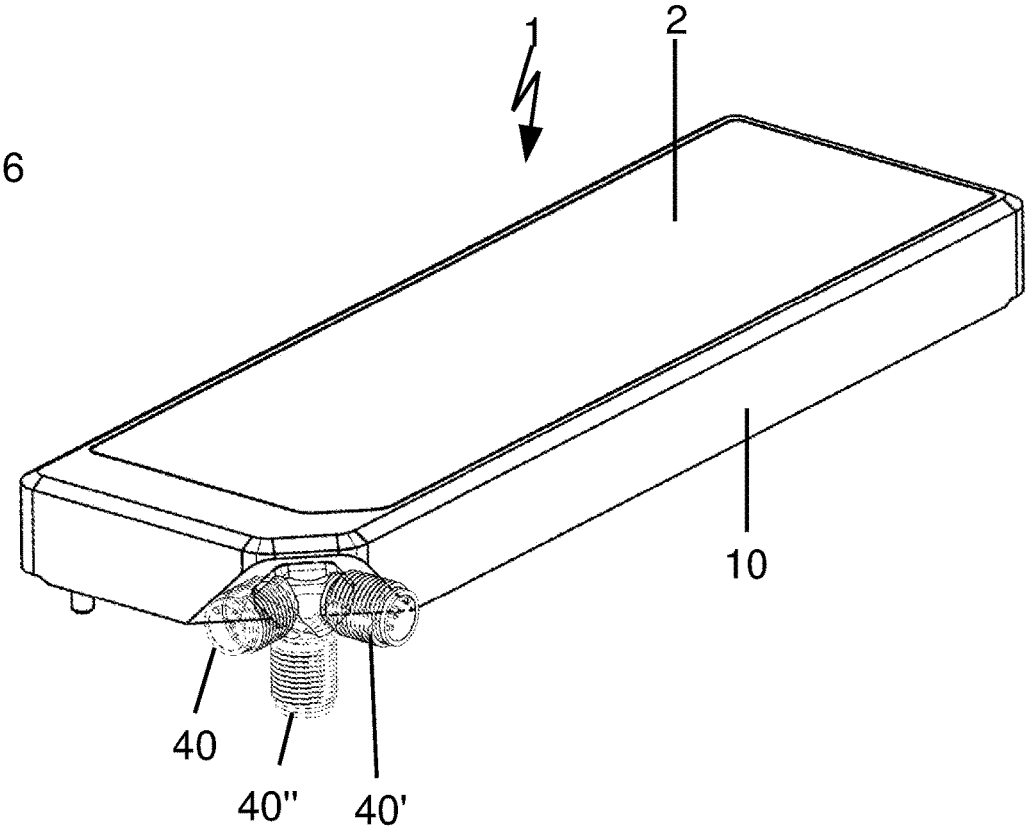
FIG. 6 shows the luminaire from FIG. 1, for which different positions of the plug are shown schematically.

FIG. 1 is an embodiment example of a luminaire 1. The luminaire 1 has a substantially flat light exit region 2, which is enclosed by a substantially rectangular luminaire frame 10. The luminaire frame 10 spans a first plane E on which the frame height H is perpendicular. In order to supply the luminaire 1 with power a plug 40 is provided, which is electrically connected to a plug contact 30 (not shown in FIG. 1) of the luminaire 1 which is provided on a beveled surface 12 that is arranged at one of the corners 11 of the luminaire 1.

Figure 2:
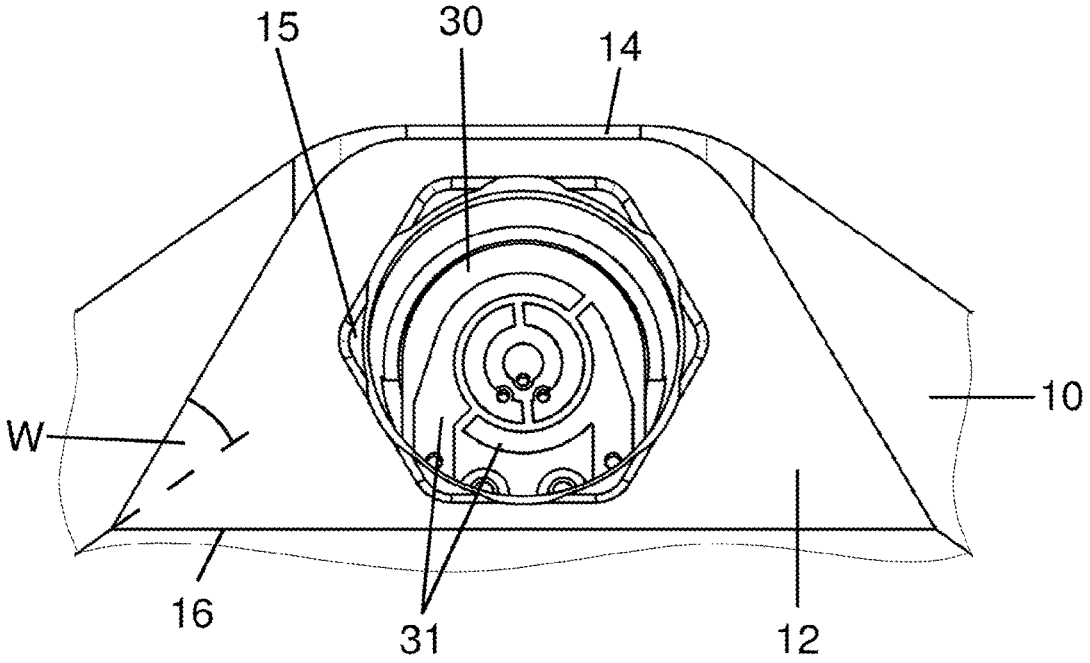
FIG. 2 shows the plug contact of the luminaire from FIG. 1 in an enlarged view with the plug removed.

It is particularly clear in FIG. 2, in which this portion of the luminaire 1 is shown with the plug 40 removed, that the beveled surface 12 extends at an angle W of at least approximately 45° to the first plane E. The beveled surface 12 is trapezoidal when viewed from above, the shorter side 14 of the trapezoid facing toward the light exit face, that is, the face on which the light exit region 2 is located, and the longer face 16 of the trapezoidal shape facing away from said region.

The plug contact 30 is located in an opening 15 or recess, which is a hexagonal pocket, and comprises sliding contacts 31. As is shown by way of example in FIG. 4, said contact can be integrated, in particular, on a printed circuit board 32 which carries the control electronics 33 for the luminaire 1. In order to arrange such control electronics 33 in the interior of the luminaire, it can also be useful for a face 10*a* of the luminaire frame 10, which abuts the beveled surface, to have a U-profile having a base 17 of the U that extends in parallel with the frame height and having limbs 19 that are situated in the plane of the light exit region and in the plane of the rear face of the luminaire 1 which is opposite the light exit region. This allows the luminaire frame 10 to form with its face 10*a* a housing portion in which the control electronics 33, which are subsequently virtually located in the interior of the U-profile, are integrated.

Figure 3:
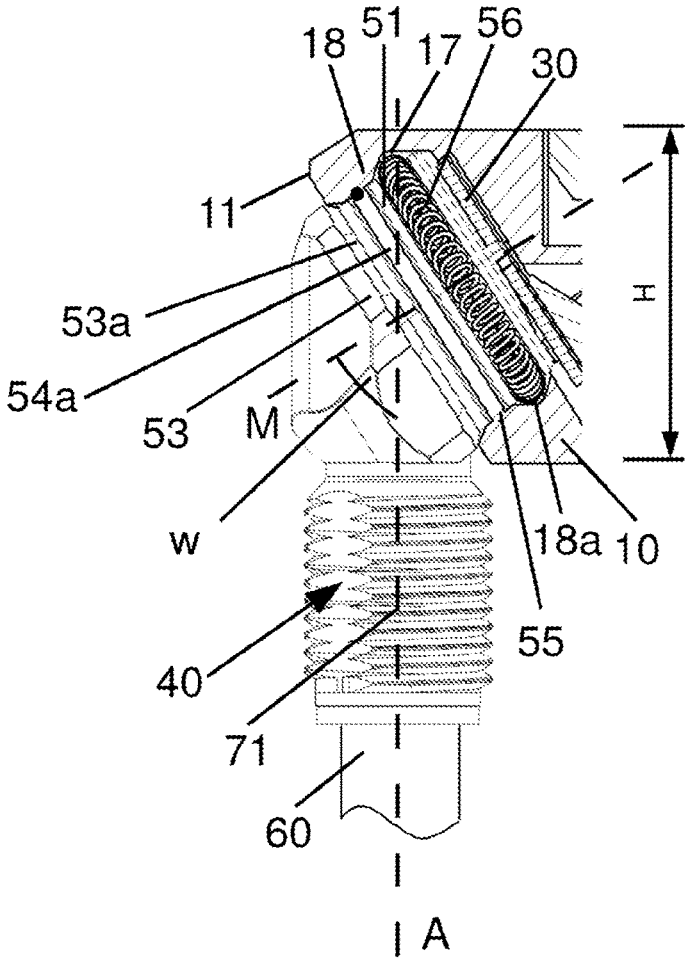
FIG. 3 is a partially opened view of the connection between the plug contact and plug of an embodiment of an electromechanical plug connector for a luminaire of this kind.

FIG. 3 is a partially opened view of the connection between plug contact 30 and plug 40 of an embodiment of an electromechanical plug connector, such as that which can be used with a luminaire 1.

The electromechanical plug connector comprises a plug 40 for arranging on a cable 60 and a mating plug, which, in the embodiment shown, is formed by the plug contact 30 having sliding contacts 31 (not shown in FIG. 30) and the region of the beveled surface 12 that surrounds said contact and forms the walls 18 of the opening 15.

Figure 4:
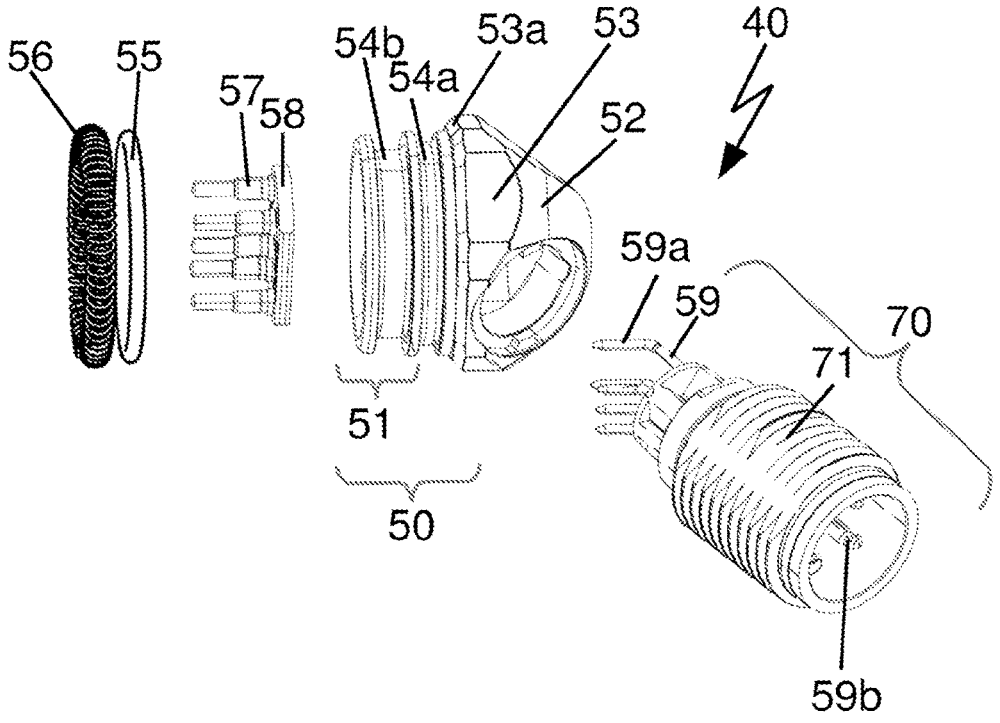
FIG. 4 is an exploded view of the plug of the electromechanical plug connection from FIG. 3.

The plug 40, which is shown in an exploded view in FIG. 4, to which reference is also made, comprises a contact region 50 for establishing mechanical contact with the mating plug and for establishing electrical contact between the contacts of the plug 40 and the contacts of the mating plug that are formed by the sliding contacts 31 of the plug contact 30 and additionally comprises a connection region 70 for connection to the cable 60, which region extends at an angle from the contact region 50.

The angle w, at which the contact region 50 is angled relative to the connection region 70, is selected here by way of example such that, with a center axis A of the connection region 70 aligned in parallel with the height H of the luminaire frame, the center axis M of the contact region 50 is perpendicular on the beveled surface 12 and thus extends in the plugging direction. Correspondingly, the angle w results from the above-defined angle W by the relationship $w=90°-W$. Correspondingly, angles that are at most approximately 45° are preferable and angles between approximately 30° and approximately 45° are particularly preferable.

The contacts of the plug 40 can be designed, in particular, as a group of spring-loaded contact pins 57 that are fastened in the interior of a tubular portion 51 of a plug housing 52 to a printed circuit board that is oriented perpendicularly to the plug-in direction of the plug 40 and is arranged in the contact region 50 inside the plug housing 52 and are pressed against the sliding contacts 31 by the springs of said contact pins when they are inserted. The spring-loaded contact pins can then be brought into electrical contact inside the plug housing 52, directly or via conductor track connectors provided on the circuit board, with the angled end portions 59*a* of connection pins 59 of a contact support 71 that is arranged in the angled connection region 70 or forms said connection region 70. The connection pins 59 are then in turn connected to the wires of the cable 60 via the cable-side end portions 59*b* of said pins.

The plug 40 and the mating plug also comprise means for forming a form fit when force is applied to said means and when the plug 40 and mating plug are connected, which are designed such that the form fit can be established in different positions that each lead in different extension directions of the connection region of the plug 40 in the room. On the side of the mating plug, said means is the opening 15 designed as a hexagonal pocket. On the side of the plug 40, the tubular portion 51 is surrounded in its end region opposite the plug-in direction by a peripheral hexagonal projection 53, which is adapted to the geometry of the hexagonal pocket and comprises a bevel 53*a* for aiding insertion into the hexagonal pocket. When the hexagonal projection 53 is inserted into the hexagonal pocket and fixed there by a force, a form fit is established between these components that prevents the plug 40 from rotating relative to the mating plug. There are, of course, six different positions in which this form fit can be established.

The tubular portion 51 has two circumferential grooves 54*a*, 54*b* in its outer wall. An O-ring 55 that produces a sealing effect when the electromechanical plug connector is assembled is arranged in the groove 54*a*. In the groove 54*b*, an annular spring 56 is mounted that, by interacting with a circumferential insert groove 18*a* in the wall 18 of the opening 15 of the beveled surface 12 associated with the frame 11, which opening is formed by the hexagonal pocket, resiliently applies a force to the described means for forming the form fit so that said force holds the hexagonal projection 53 in the hexagonal pocket or pulls it into said pocket.

Therefore, a latching connection is formed here by means of the annular spring 56 on the plug 40 and an associated insert groove 18*a* in the wall 18 of the opening 15 or recess in the luminaire frame 11, which is designed as a hexagonal pocket, which are each operatively connected to one another.

When a rotational movement of the plug 40 about the center axis of the hexagonal pocket starting from a latched position is initiated, the interaction of the bevel 53*a* with the outer edge of the hexagonal pocket generates a force that, as soon as it temporarily overcomes the resilient force of the plug 40 thanks to the interaction of the annular spring 56 and insert groove 18*a* in the wall 18, pushes the plug 40 out of the form fit so that the plug 40 can rotate relative to the mating plug.

If the next position in which the hexagonal edge 53 can be received in a snug fit in the hexagonal pocket is reached, the interaction of the bevel 53*a* with the edge of the hexagonal pocket does not occur, and the plug 40 is pulled back into the hexagonal pocket, said plug then being transferred from a first position of the different positions to a second position of the different positions by the resilient force being temporarily overcome.

Correspondingly, the six positions in which the hexagonal edge 53 can be received in a snug fit in the hexagonal pocket form six latching positions of the electromechanical plug connector that can be transferred into one another when the electromechanical plug connector is plugged in.

The contacts of the plug 40, in this example the spring-loaded contact pins 57, are also rotated and come into contact with the sliding contacts 31 again at a different point on the sliding contacts 31, the geometry of which is designed such that, in all positions in which the form fit is established, electrical contact is established at least between some contacts of the mating plug and some contacts of the plug.

Figure 5:
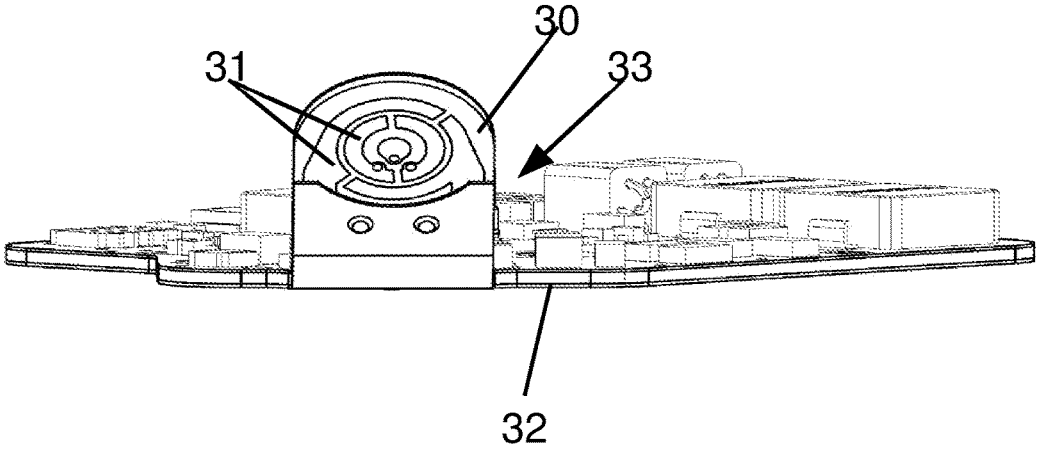
FIG. 5 shows control electronics of a luminaire having a plug contact that is shown in FIG. 2.

It should also be noted that this in particular not only achieves a change in the cable run direction starting from the luminaire, as shown schematically in FIG. 5 with the different aligned plugs 40, 40', and 40" that are each identical to the plug 40 and are merely set in another one of the latching positions relative to the mating plug.

It also makes it possible, in principle, to achieve a switching function. A switching effect of this kind occurs, for example, if the point of the sliding contacts 31 that is contacted after a change of this kind in the latching position is not electrically conductively connected to the point of the sliding contacts 31 that is contacted before the change, and therefore another component of the control electronics 33 is then supplied with power and/or another spring-loaded contact pin 57 is brought into contact with the sliding contact 31, and therefore a different signal or a current with different parameters is fed to a given component of the control electronics 33.

LIST OF REFERENCE SYMBOLS

1 luminaire
2 light exit region
10 luminaire frame
10*a* face
11 corner
12 beveled surface
14 shorter face
15 opening
16 longer face
17 base
18 wall
18*a* insert groove
19 limb
30 plug contact
31 sliding contact
32 printed circuit board
33 control electronics
40, 40', 40" plug
50 contact region
51 tubular portion
52 plug housing
53 hexagonal projection
53*a* bevel
54*a*, 54*b* groove
55 O-ring
56 annular spring
57 contact pin
58 printed circuit board
59 connection pin
59*a* angled end portion
59*b* cable-side end portion
60 cable
70 connection region
71 contact support
E plane
M center axis
W angle
w angle

The invention claimed is:

1. A luminaire (1) having a flat light exit region (2) that is surrounded by a rectangular luminaire frame (10), wherein the rectangular luminaire frame (10) spans a first plane (E) and has a frame height (H) that is perpendicular to the first plane (E) and, at one of its corners (11), a beveled surface (12) in which a plug contact (30) is arranged, wherein the beveled surface (12) is angled such that a plane defining the beveled surface (12) is non-parallel and non-perpendicular with respect to the first plane (E).

2. The luminaire (1) according to claim 1, characterized in that the beveled surface (12) extends at an angle (W) of at least approximately 45° to the first plane (E).

3. The luminaire (1) according to claim 2, wherein the angle (W) is between approximately 45° and approximately 60° to the first plane (E).

4. The luminaire (1) according to claim 1, characterized in that the beveled surface (12) is trapezoidal when viewed from above, the shorter side (14) of the trapezoid facing toward the light exit region (2) and the longer side (16) of the trapezoid facing away from said region.

5. The luminaire (1) according to claim 1, characterized in that that the beveled surface (12) comprises an opening (15) or recess in which the plug contact (30) is located.

6. The luminaire (1) according to claim 5, characterized in that the opening (15) or recess is a polygon.

7. The luminaire (1) according to claim 6, wherein the opening (15) or the recess comprises a hexagonal pocket.

8. The luminaire (1) according to claim 5, characterized in that the plug contact (30) located in the recess (15) or opening comprises sliding contacts (31).

9. A use of the luminaire according to claim 1, as a machine luminaire.

10. An electromechanical plug connector having a plug (40) for arranging on a cable (60) and having a mating plug (50) for arranging on an electrical device, wherein the electrical device comprises the luminaire according to claim 1, wherein the plug (40) comprises a contact region (50) for establishing mechanical contact with the mating plug and for establishing electrical contact between contacts of the plug (40) and contacts of the mating plug and additionally comprises a connection region (70) for connection to the cable (60), which region extends at an angle from the contact region (50), wherein the plug (40) and the mating plug comprise means for forming a form fit when force is applied to said means and when the plug (40) and mating plug are connected, which are designed such that the form fit can be established in different positions that each lead in different extension directions of the connection region (70) of the plug (40) in the room, wherein the plug (40) and/or the mating plug also comprise means for resiliently applying a force to the means for forming the form fit so that the form fit can be transferred from a first position of the different positions to a second position of the different positions by the force being temporarily overcome, and wherein the contacts of the plug (40) and/or the contacts of the mating plug are designed such that, in all positions in which the form fit is established, an electrical contact is established at least between some contacts of the mating plug and some contacts of the plug (40).

11. The electromechanical plug connector according to claim 10, characterized in that the contact region (50) and the connection region (70) are at an angle (w) of at most approximately 45° from one another other.

12. The electromechanical plug connector according to claim 11, wherein the angle (w) is between approximately 30° and approximately 45°.

13. The electromechanical plug connection according to claim 10, characterized in that the electromechanical plug connector can be rotated.

14. The electromechanical plug connector according to claim 13, characterized in that the electromechanical plug-in connection comprises a plurality of latching positions, the latching positions each being assigned to a different rotational position of the plug (40).

15. The electromechanical plug connector according to claim 14, characterized in that the latching connection is in operative connection on the plug (40) and an assigned insert groove (18*a*) in the opening (15) or a recess of the rectangular luminaire frame (10) by means of an annular spring (56).

* * * * *